US008356574B2

(12) United States Patent
Wurster

(10) Patent No.: US 8,356,574 B2
(45) Date of Patent: Jan. 22, 2013

(54) DEVICE AND METHOD FOR COATING WHEEL RIMS

(75) Inventor: Gerd Wurster, Stuttgart (DE)

(73) Assignee: Gerd Wurster, Stuttgart (DE)

( * ) Notice: Subject to any disclaimer, the term of this patent is extended or adjusted under 35 U.S.C. 154(b) by 683 days.

(21) Appl. No.: 12/528,275

(22) Filed: Aug. 21, 2009

(65) Prior Publication Data

US 2010/0291300 A1 Nov. 18, 2010

Related U.S. Application Data

(63) Continuation of application No. PCT/EP2008/000913, filed on Feb. 2, 2008.

(30) Foreign Application Priority Data

Feb. 23, 2007 (DE) ..... 10 2007 010 312

(51) Int. Cl.
*B05B 13/02* (2006.01)
*B05B 15/12* (2006.01)
*B05D 7/00* (2006.01)

(52) U.S. Cl. ..... 118/669; 118/668; 118/675; 118/676; 118/686; 118/687; 118/500; 427/402; 427/407.1; 427/409; 427/189; 427/195; 427/421.1; 427/424; 427/427.4; 427/427.5; 427/372.2

(58) Field of Classification Search ..... 118/500, 118/668, 669, 675, 676, 686, 687; 427/402, 427/407.1, 189, 195, 421.1, 424, 427.4, 427.5, 427/372.2

See application file for complete search history.

(56) References Cited

U.S. PATENT DOCUMENTS 4,763,392 A * 8/1988 Fogal et al. ..... 427/327
5,226,971 A * 7/1993 Fogal et al. ..... 134/17
5,769,949 A 6/1998 Cienkus et al.

FOREIGN PATENT DOCUMENTS

| | | | |
|---|---|---|---|
| DE | 19702323 | | 7/1998 |
| DE | 19526613 | C2 | 8/1998 |
| DE | 19819963 | | 11/1999 |
| EP | 1 108 478 | A2 * | 6/2001 |
| EP | 1108478 | | 6/2001 |
| WO | 2007014814 | | 2/2007 |
| WO | WO 2007/014814 | A1 * | 2/2007 |

OTHER PUBLICATIONS

International Preliminary Report on Patentability for PCT/EP2008/000913, Sep. 8, 2009, 9 pgs.*

International Search Report, Application No. PCT/EP2008/000913, May 8, 2008.

Helmut Hoch;"Perfekte Oberflachen fur Alurader" with English Abstract, JOT Aug. 2003; pp. 22-24, 26-27.

Ferdinand Fried;"MaterialfluBautomation in Lackierstraben: Flexibler and rationeller mit moderner Forder-und Steuerungstechnik" with English abstract, I-Lack 4/89; pp. 125-129.

* cited by examiner

*Primary Examiner* — William Phillip Fletcher, III
(74) *Attorney, Agent, or Firm* — Bracewell & Giuliani LLP

(57) ABSTRACT

Devices and methods for coating wheel rims for the production of both standard rims and special rims, are provided. An example of a device for coating wheel rims includes a pre-treating station that is followed by a powder priming station followed by a basecoat application station and a final coating station, in particular an acrylate powder station, with the final coating station being coupled to both the power priming station and the pre-treating station by at least one conveyor, respectively. The device permits a proportion of special rims to be introduced in addition to standard rims without any impairment of the spindle-synchronous operation of the device.

20 Claims, 4 Drawing Sheets

DEVICE AND METHOD FOR COATING WHEEL RIMS

RELATED APPLICATIONS

This application is a continuation application of copending International Patent Application PCT/EP2008/000913 filed on Feb. 6, 2008 and claiming priority of German Patent Application DE 10 2007 010 312.5 filed on Feb. 23, 2007, the contents of which is fully incorporated herewith by reference.

BACKGROUND OF THE INVENTION

The present invention relates to a device for coating wheel rims, designed for the production of standard rims as well as for the production of special rims (gloss-copied rims), having a pre-treating station that is followed by a powder priming station followed by a final coating station, in particular an acrylate powder station.

The invention further relates to a method for coating wheel rims, which includes the steps of pre-treating the rims in a pre-treating station, transferring the pre-treated blanks to a powder priming station for coating, and coating the blanks with a finishing coating in a final coating station.

In known installions for coating wheel rims the rims initially are run through a pre-treating station, then through a powder priming station and finally through a final coating station, where they are provided with a finishing coat, preferably with an acrylate powder.

In addition to those usual methods for the production of standard wheel rims (high-alloy wheel rims made from aluminum or sometimes magnesium alloys) a constantly rising demand for what is known as "gloss-copied rims" (also known as "gloss-turned" rims) has developed more recently. In producing such wheel rims, which have a high-gloss surface and which will be designated hereafter as "special rims", the surfaces of standard rims, having been powder-coated before, are mechanically reworked in a turning station, for example by turning, so that only a rest of the previously applied powder coating will be left on their surface. The blanks so treated (hereinafter referred to as special blanks) are subjected to an additional pre-treatment, followed by a final coating operation, preferably again an acrylate powder coating operation. In order to obtain such high-gloss surfaces also in the subsequent steps, the pre-treatment differs a little, with respect to certain process steps, from the usual pre-treatment of standard rims. Still, quite a number of pre-treatment steps can be carried out together with the pre-treatment of standard rims.

In prior art systems, special rims and standard rims are treated sequentially in a common system. As conveyor stations of rim coating systems operate in synchronism, it is necessary to provide an in particular assigned location for each blank. A buffer does not exist in the different stations of the system. This means that the entire system can be operated only with a uniform cycle time to guarantee that the parts are transferred through the system in a controlled way.

If special rims are to be produced on a conventional station, on which standard rims had been produced before, part of the station first has to be run empty before special blanks for special rims can be processed. In particular in cases where only a few special rims are to be produced, this results in considerable disadvantages with respect to time, down-time losses and considerable energy losses in operation of the entire station.

SUMMARY OF THE INVENTION

In view of this it is a first object of the present invention to provide a device for coating wheel rims, which allows the production of both standard rims and special rims and which allows a greater flexibility in the production of special rims than possible in prior art designs.

It is a second object of the invention to disclose a device for coating wheel rims, which allows the simultaneous production of both standard rims and special rims and which is simple in design.

It is a third object of the invention to disclose a device for coating wheel rims, which allows the simultaneous production of both standard rims and special rims and which allows for a space saving and cost-effective design.

It is a forth object of the invention to disclose a device for coating wheel rims, which allows the production of both standard rims and special rims and which keeps down-times and energy consumption as low as possible.

It is a fifth object of the current invention to disclose a method for producing both standard rims and special rims simultaneously with great flexibility.

According to the invention these and other objects are achieved by a device for coating wheel rims, designed for the production of standard rims as well as for the production of special rims (gloss-copied rims), having a pre-treating station that is followed by a powder priming station followed by a basecoat application station and a final coating station, in particular an acrylate powder station, where at least the powder priming station, the basecoat application station and the final coating station are coupled one to the other via conveyors and handling mechanism for spindle-synchronous operation, where the final coating station is coupled to both the pre-treating station and the basecoat application station, and where at least one conveyor, intended to transfer the rims through the final coating station, has a capacity of rim locations sufficient to allow both standard rims and special rims to be accepted in spindle-synchronous operation.

The object of the invention is further achieved by a method for coating wheel rims comprising the steps of:

(a) pre-treating blanks in a pre-treating station;

(b) transferring the pre-treated blanks, in spindle synchronous operation, to a conveyor for transfer through a powder priming station (21) for powder priming, baking and drying of the blanks;

(c) transferring the blanks, in spindle synchronous operation, through a basecoat application station for application of a basecoat;

(d) conveying the blanks, in spindle synchronous operation, to a final coating station and conveying the blanks, in spindle-synchronous operation, through the final coating station for final coating of the blanks, preferably using an acrylate powder;

(e) pre-treating special blanks (which previously have been powder coated and mechanically treated) in the pre-treating station;

(f) transferring the special blanks, in spindle-synchronous operation, from the pre-treating station to free locations of a conveyor, for transfer through the final coating station; and (g) applying the final coating on the blanks and the special blanks in the final coating station.

The object of the invention is thus perfectly achieved.

Throughout this application a "spindle-synchronous operation" is understood as an operation of the device for coating wheel rims which avoids any undesired double occupations of rims to rim locations provided on conveyors or handling devices which serve to move rims through the device. A common central electronic control is provided for controlling each rim location provided on all conveyors and handling devices for moving rims through the device. The electronic control keeps track of each rim location and always knows whether a particular location is free or occupied. Thus a spindle-synchronous operation means that all the conveyors advance in a certain cycle time to the next location, while it is ensured by the electronic control that double or multiple assignments to any rim location are avoided.

By providing that at least one conveyor intended to transfer the rims through the final coating station is designed so that special rims can be placed on free locations of the conveyor in spindle-synchronous operation so that standard rims and special rims can be subjected to the final coating process in parallel and in spindle-synchronous operation, the invention provides the advantage that the station no longer has to be run empty for being switched over between standard rims and special rims, or vice versa. Instead, special rims can be treated in the device according to the invention in parallel with standard rims. With the result that down-times and related energy losses can be avoided. Depending on the particular design of the conveyor of the final coating station, and of the other conveyors of the other stations of the station, it is thereby possible at any time, with practically no preceding down-times, to process a certain portion of special rims in parallel with standard rims.

Optionally, the basecoat application station may be followed by a spray station for a transparent coating operation.

This allows an in particular low-cost treatment of standard rims as in that case one can do without the more expensive step of a finishing treatment by an acrylate powder coating operation.

According to a preferred further development of the invention, the pre-treating station is designed for pre-treating standard blanks as well as for pre-treating special blanks.

This allows the entire system to be made more compact and to achieve a corresponding reduction in costs. The fact that individual stations of the pre-treating station can be used for the treatment of both standard blanks and special blanks, results in a more efficient utilization of the pre-treating station and in a more compact structure and, consequently, in corresponding cost savings.

According to a first variant of that embodiment, the pre-treating station comprises a conveyor that runs through different treating stations for blanks and special blanks, which can be connected to the system, or to which the system can be switched over optionally.

This allows an in particular simple structure of the pre-treating station to be achieved.

According to another variant of the invention, the pre-treating station comprises at least two spray tunnels, each designed for pre-treating blanks and for pre-treating special blanks, and each being preferably assigned a separate conveyor.

In this way it is possible to guarantee an in particular high throughput. At the same time, a treatment of in particular high quality can be guaranteed, in particular for special blanks, as the different treating stations may be arranged separately one from the other, if necessary. Contaminations can be avoided in this way. Also there is no need in this case for switching over between the pre-treatment of standard rims and the pre-treatment of special rims.

Alternatively, a plurality of separate pre-treatment systems can be provided for the pre-treatment of standard rims and special rims.

According to another embodiment of the invention, the final coating station comprises a powder booth, a dryer and a cooling zone that are passed by a common conveyor designed for taking up both blanks and special blanks.

This allows the entire final coating station to be used for powder coating of blanks or of special blanks. It is understood that the conveying capacity of the common conveyor is made sufficiently high to permit the final coating of blanks and special blanks to be effected within the defined cycle time. With a final coating station designed, for example, for 600 parts/hour, it is possible in this way to carry out the final treatment on 600 special rims/hour, for example, or, for example, on 400 standard rims and at the same time on 200 special rims arriving directly from the pre-treating station.

The conveyors may be designed, for example, as circular conveyors, spindle conveyors, floor conveyors or power & free conveyors.

According to one further development of the invention, a power & free conveyor, coupled with buffers for pre-treated blanks and special blanks, is provided in the area of the pre-treating station.

By using a power & free conveyor, improved flexibility is guaranteed in the zone of the pre-treating station so that the special treatment required for special blanks can be carried out, or selected by switching-over, in a simple way without any need for a plurality of conveyors. When a single power & free conveyor is used, then the use of buffers provides improved flexibility and some storage capacity.

On the other hand, the use of buffers is connected with a risk of over-flow. This can be avoided by having the special blanks and the blanks in the pre-treating station transported by separate conveyors, for example two circular conveyors.

In the case of the method according to the invention, the blanks and special blanks preferably are transported through the pre-treating station, and stations for the pre-treatment of the blanks and of the special blanks are selectively connected to the system or selected by switching-over, or the blanks and the special blanks are selectively conveyed through separate spray tunnels. In the latter case, a separate conveyor is required for each spray tunnel.

According to another embodiment of the invention, a common conveyor is used in the pre-treating station to convey the blanks and the special blanks through a common drying zone and cooling zone.

This leads to a simple and compact structure of the entire system.

If desired, the blanks can be provided with a transparent coating in a spraying station, following the basecoat application process.

That process is cheaper than a final treatment with an acrylate powder coating.

It is understood that the features of the invention mentioned above and those yet to be explained below can be used not only in the respective combination indicated, but also in other combinations or in isolation, without leaving the scope of the invention.

BRIEF DESCRIPTION OF THE DRAWINGS

Further features and advantages of the invention will become apparent from the description that follows of certain preferred embodiments, with reference to the drawing. In the drawing

DETAILED DESCRIPTION OF THE PREFERRED EMBODIMENTS

Figure 1:
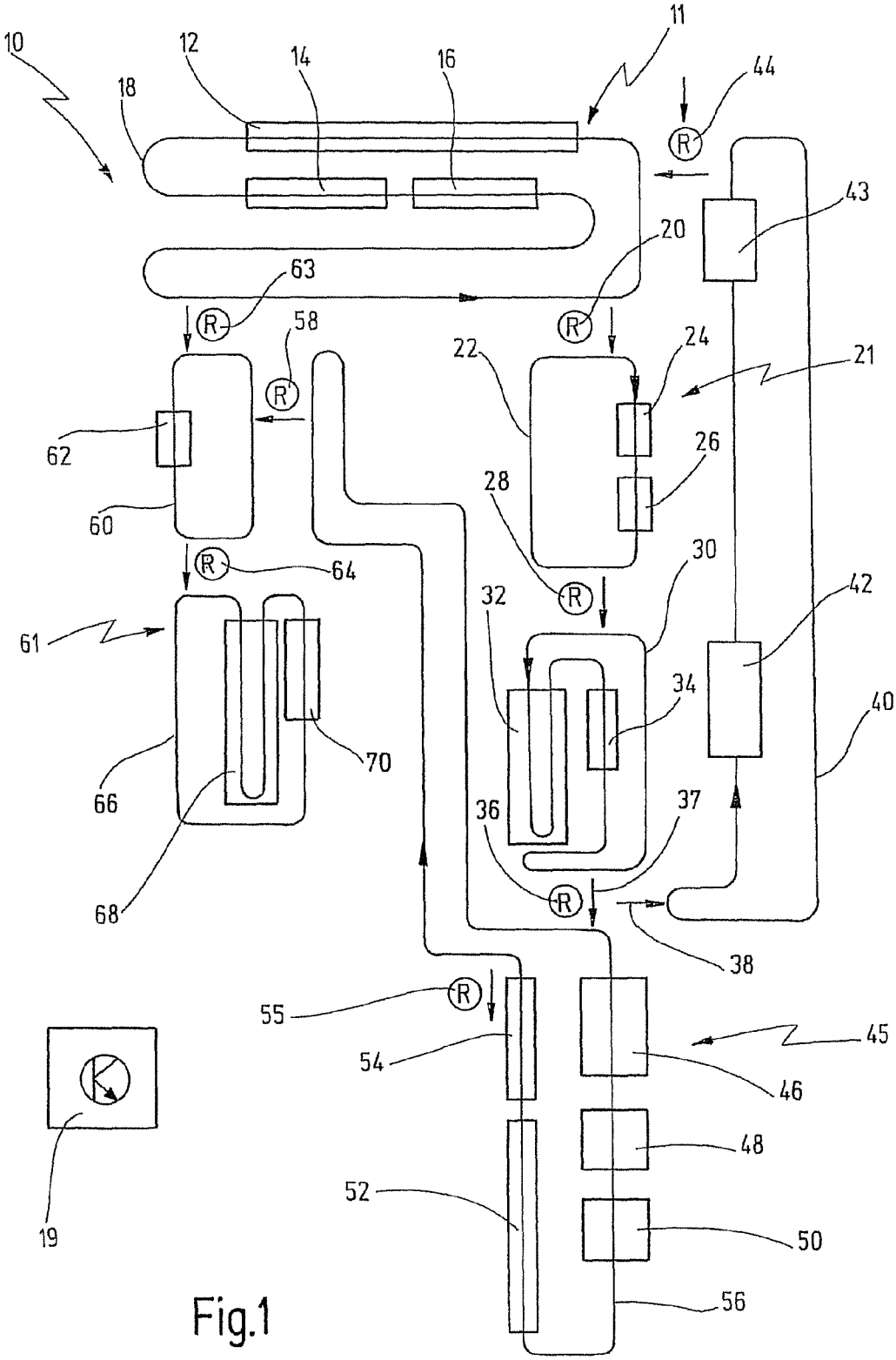
FIG. 1 shows an overall diagram of an station according to the invention.

In FIG. 1, a device according to the invention for coating rims, designed for the production of standard rims as well as for the production of special rims, is shown diagrammatically and indicated generally by reference numeral 10.

The device 10 comprises a pre-treating station 11, a powder priming station 21, followed by a basecoat application station 45 with a pre-heating station 46 (drier), a spray booth 48 for application of a basecoat (generally a silver primer), a drier 52 for baking and a cooling zone 54. Between the spray booth 48 and the dryer 42. there may be optionally provided another spray booth 50 for application of a transparent lacquer.

The device 10 further comprises a final coating station 61, designed for application of an acrylate powder coating. The final coating station is arranged and designed to permit not only the transfer of parts arriving from the powder priming station 21 or the transparent spray-coating system 45, but also the direct transfer of parts arriving from the pre-treating station 11.

The pre-treating station 11 is designed for the pre-treatment of "standard blanks" as well as for the pre-treatment of "special blanks" (i.e. previously powder-coated rims that have been mechanically reworked, for example gloss-turned). The pre-treating station 11 comprises a spray booth 12, followed by a drier 14 and a cooling zone 16 that are served by a common conveyor 18. The conveyor 18 may be designed as a circular conveyor, for example.

Arranged downstream of the pre-treating station 11 is a powder priming station 21. The powder priming station 21 comprises a conveyor 22 designed as a spindle conveyor or a floor conveyor running through a first powder booth 24 and/or a second powder booth 26 (for a priming process with a different color). The conveyor 22 is coupled with the conveyor 18 of the pre-treating station via a handling mechanism 20, preferably a robot. Another handling mechanism 28, likewise preferably consisting of a robot, permits parts to be transferred to another conveyor 30. Preferably, the other conveyor 30 is again designed as a spindle conveyor or a floor conveyor. Using the conveyor 30, parts that have been powder coated in the powder booths 24 or 26 are conveyed to a baking furnace (drier) 32 for baking the powder coat, and are then transported through a cooling zone 34.

Using another handling device 36, which preferably may again consist of a robot, parts can be taken over from the conveyor 30 and transferred to a downstream conveyor 56 that runs the parts through the basecoat application station 45 and allows the parts to be transferred to the final coating station 61 via a further handling mechanism 58 (preferably in the form of a robot). Alternatively, the parts can be transferred via a handling mechanism 36 to a conveyor 40 by which the parts are conveyed to one or more mechanical reworking stations 42, for example a gloss-turning station. Mechanical reworking has the effect to largely remove the surface of the previously powder-coated parts to provide a base for a high-gloss coating, for the production of special rims. The mechanical reworking station 42 is illustrated by way of example only and is preferably provided with one or more buffers of sufficient capacity so that a sufficient number of mechanically reworked special blanks will be available for being optionally conveyed to a pre-treating station 11 via a handling mechanism 44 (preferably a robot). Another buffer 43 may be provided immediately upstream of the handling device 44. The handling device 44 therefore can supply the pre-treating station 11 optionally with blanks for the production of standard rims or with special blanks for the production of special rims.

Standard rims, which after transfer through a pre-drier 46 have run through a spray booth 48 for application of a basecoat, may optionally be conveyed through the spray booth 50 for application of a transparent lacquer. Thereafter, the parts are transported by the conveyor 56 through a drier 52 for baking, and finally through a down-stream cooling zone 54.

Rims that have been treated with transparent lacquer in the described way preferably are removed from the system using a handling mechanism 55. Parts not treated with a transparent lacquer are then conveyed to the handling mechanism 58 by means of which they are transferred to the final coating station 61.

The spray booth 50 optionally provided for application of a transparent lacquer may be used for treating standard rims only. In some cases, however, customers desire standard rims which, following the basecoat application (as a rule using a silver lacquer) receive a final transparent coating only.

Most of the standard rims receive, however, an acrylate powder coating (without previous application of a transparent lacquer) following the basecoat application (as a rule using a silver lacquer).

In any case, it is rendered possible by the conveyor 56, which is again designed as a spindle conveyor or a floor conveyor, to transport blanks from the powder priming station 21 via the basecoat application station 45 to the handling device 58, for transfer to the final coating station 61.

The final coating station 61 comprises a conveyor 60 which, preferably, is again designed as a spindle conveyor or a floor conveyor. Using the conveyor 60, blanks or special blanks can be transported through a powder booth 62, for preferably applying an acrylate powder coating. The conveyor 60 is coupled with the pre-treating station 11 via a handling mechanism 63 in the form of a robot. Using the handling device 63 it is therefore possible to transfer special blanks, which have received a pre-treatment, from the pre-treating station 11 directly to the final coating station 61. In addition, or alternatively, blanks that have been powder-coated in the powder priming station 21 can be transferred to the conveyor 60 by the handling mechanism 58. From the conveyor 60, the parts at first run through the powder booth 62 and then reach another handling mechanism 64, preferably again designed as a robot. Using the handling mechanism 64, the parts can be transferred to a further conveyor 66, likewise preferably configured as a spindle conveyor or a floor conveyor. Using the conveyor 66, the parts are transferred through a drier 68 for baking of the acrylate powder coating, and finally through a downstream cooling zone 70. Thereafter, the completely treated standard rims or special rims are removed and transferred to a final inspection station, for example.

The device 10 according to the invention is controlled by a common electronic control, indicated schematically by reference numeral 19.

The pre-treating station 11, 11*a*, 11*b*, the powder priming station 21, the basecoat application station 45 and the final coating station 61 cooperate in a way that guarantees spindle-synchronous operation of the entire system. This means that every rim will always be assigned a specific position. Double-allocation of positions does not occur because no buffers are provided (except for the possible use of a power & free conveyor in the pre-treating stations). Rims can be run through the entire system exclusively according to a predetermined uniform cycle time. The fact that the final coating station 61 is used for the final coating of blanks as well as for the final coating of special blanks results in a more compact structure of the entire system and more efficient utilization. The conveyors 60 and 66 are designed for the maximum throughput of the entire system, for example for 600 blanks per hour. In contrast, the conveyors 22, 30 and 56 are as a rule designed for a lower throughput, for example for 400 blanks per hour. This allows a maximum of additional 200 blanks per hour to be conveyed directly from the pre-treating station 11 to the final coating station 61, via the handling mechanism 63. The pre-treating station 11 must of course be designed for a correspondingly high throughput to ensure both the pre-treatment of blanks and the pre-treatment of special blanks.

Possible embodiments of the pre-treating station 11 will now be described in more detail with reference to FIGS. 2 to 4.

Figure 2:
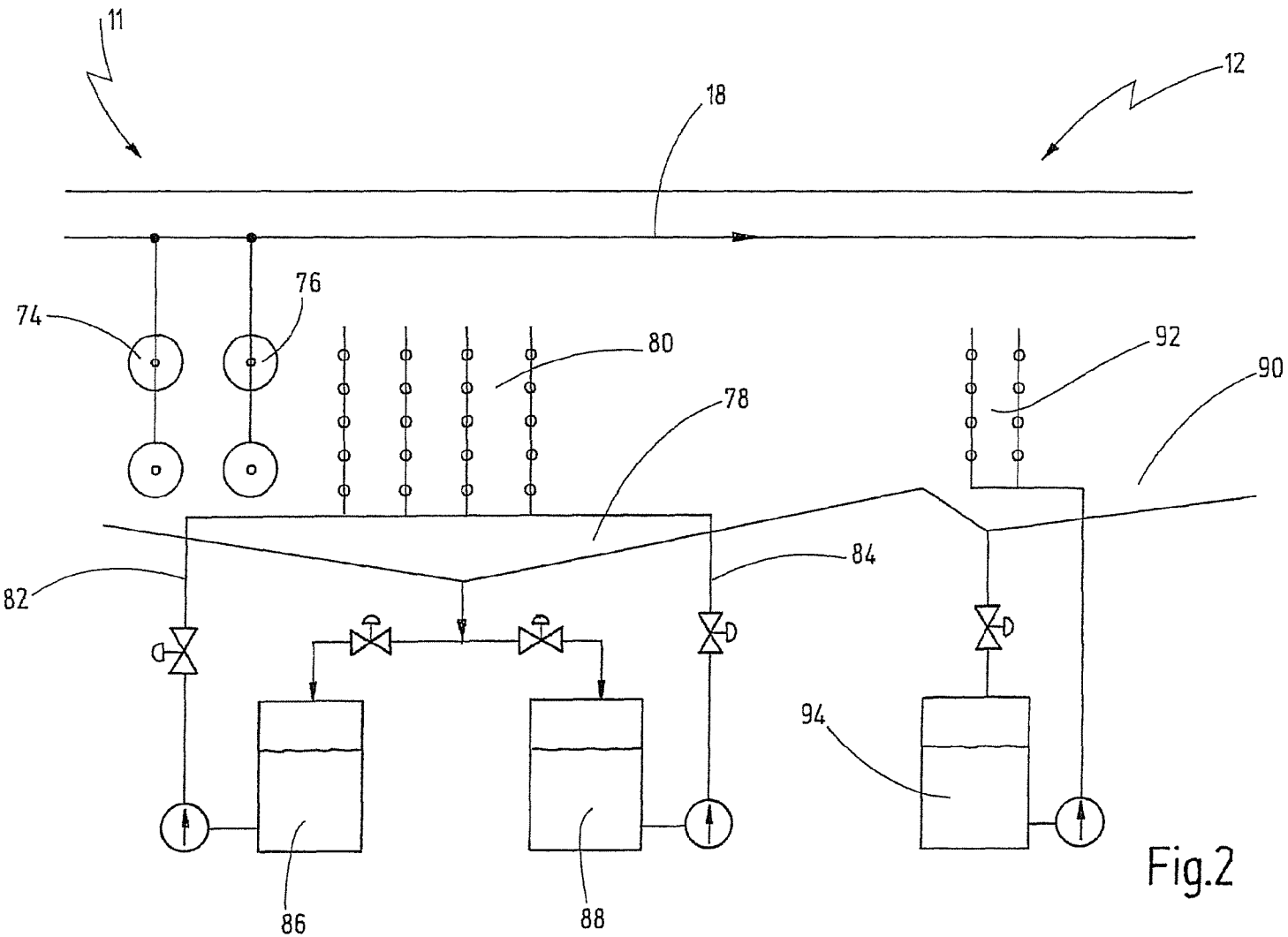
FIG. 2 shows an enlarged detail view of the pre-treating station with common conveyor, which can be switched-over between different pre-treatment zones.

FIG. 2 shows a detail of a pre-treating station 11 according to FIG. 1. The pre-treating station 11 comprises a common conveyor 18, for example in the form of a circular conveyor. The conveyor 18 conveys parts to be treated, for example blanks 74 or special blanks 76, through different zones of a common spray booth 12. The different zones of the spray tunnel 12 can be selectively activated to carry out a suitable pre-treating sequence for blanks or special blanks, respectively. For example, a first spraying zone 78 may comprise a spray register 80 which may be optionally supplied either from a first tank 76 via a first circuit 82, or from a second tank 88 via a second circuit 84. The selection may, for example, relate to pre-treatment steps such as "pickling 1" or "pickling 2", depending on which one of the two circuits 82, 84 has been activated by opening the respective valves.

The drawing shows, by way of example, a downstream spraying zone 90 with a spray register 92, which as such is supplied via a corresponding circuit from a third tank 94. It is possible in this way, with the aid of pre-treating stations that can be switched over or optionally connected, to carry out suitable pretreatment steps for pre-treating blanks and for pre-treating special blanks. The structure is relatively simple and cheap, such a system requiring only a single conveyor and a single spray tunnel.

Figure 3:
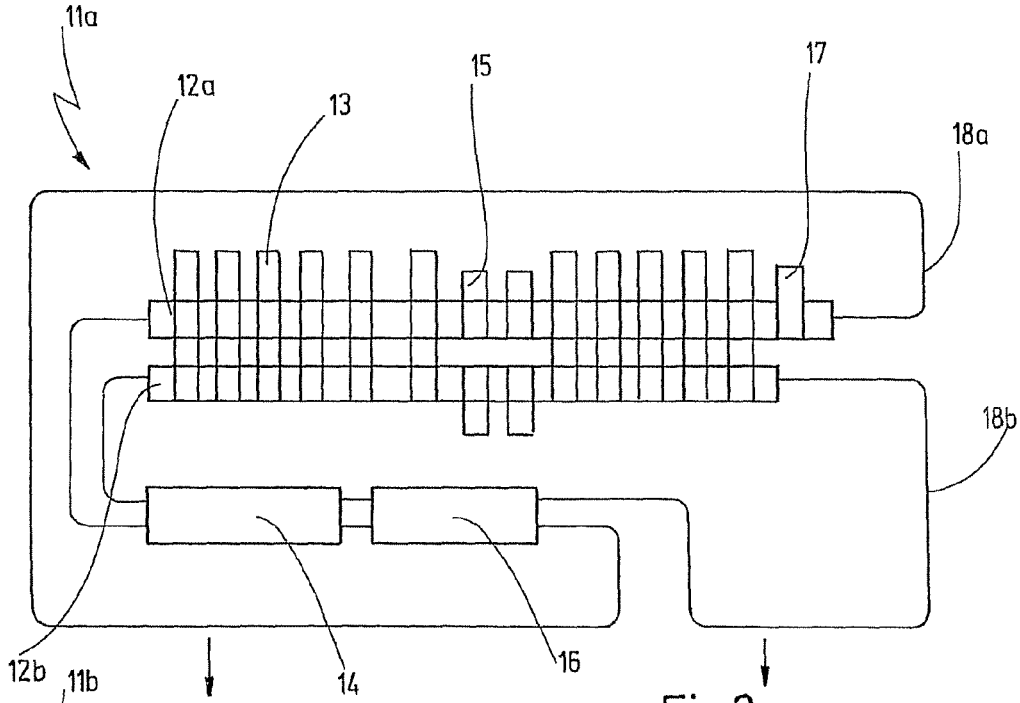
FIG. 3 shows an alternative structure of a pre-treating station with two separate spray tunnels, which are served by two conveyors.

For results of an in particular high quality it is, however, recommendable to pre-treat the blanks and the special blanks separately, in which case separate spray tunnels 12*a* and 12*b*, as shown in FIG. 3 for example, are to be provided. Each spray tunnel 12*a* or 12*b*, respectively, is served by a separate conveyor 18*a* or 18*b*, the two being subsequently run through a common drier 14 and a common cooling zone 16.

The first spray tunnel 12*a* is passed by special blanks, while the second spray tunnel 12*b* is passed by blanks. There are a number of pre-treating steps that can be carried out commonly on blanks and special blanks, which has been indicated by 13. Further, there are some treating steps that are carried out separately on blanks and special blanks, which has been indicated by 15. Finally, there are one or more pre-treating steps (such as pre-cleaning) that are carried out only on certain special blanks, which has been indicated by 17.

The blanks and/or special blanks can be taken over using the assigned handling mechanism, as indicated by the arrows, for being transferred either to the powder priming station 21 or the final coating station 61, as shown in FIG. 1.

Figure 4:
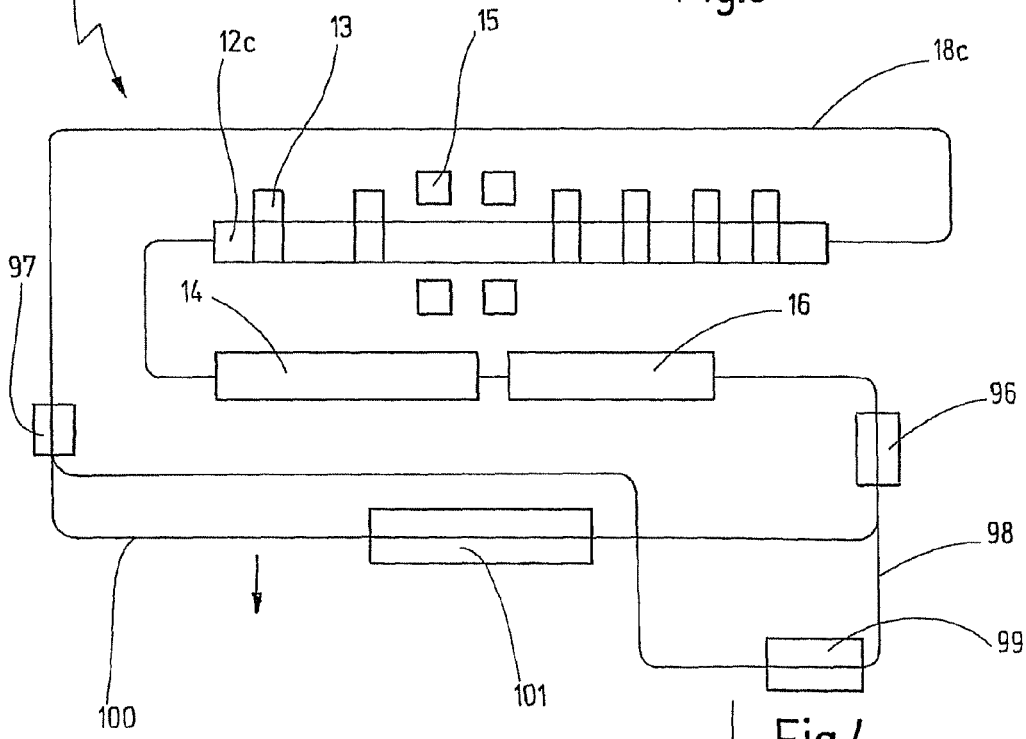
FIG. 4 shows a further alternative structure of a pre-treating station using a power & free conveyor with switching-over facility.

A further variant of a pre-treating station is shown in FIG. 4, and is indicated generally by 11*a*. In that case, a power & free conveyor 18*c* is used for transporting blanks as well as for transporting special blanks. The power & free conveyor 18*c* runs through a common spray tunnel (compare FIG. 2) with switching-over function and through a downstream drier 14 and a cooling zone 16. Once the cooling zone 16 has been left, a track switch 96 divides the conveying path into a first branch 98 and a second branch 100 which latter is coupled via a track switch 97. Blanks intended to be transferred later to the powder priming station 21 are guided into the first branch 98. The first branch 98 comprises a buffer 99 for pre-treated blanks. The second branch 100, intended for pre-treated special blanks that can be handed over directly to the final coating station 61, comprises a second buffer 101. In contrast to circular conveyors, for example, the power & free conveyor does not need to be operated in synchronism, and accordingly can operate in switching mode and may be coupled with buffers 99 or 101, respectively. However, the conveyors 22, 30, 56, 60, 66 are operated spindle-synchronously in this case as well in order to guarantee the orderly transport of parts through the entire system.

Figure 5:
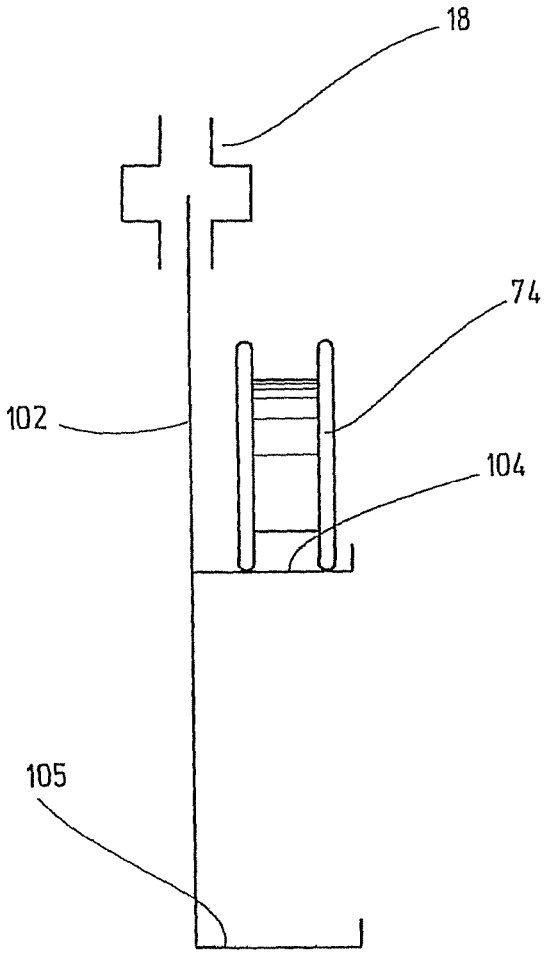
FIG. 5 shows a detail view of a suspension system for the attachment of rims to a circular conveyor.

FIG. 5 shows, for example, a product carrier 102 in the form of a suspension on a circular conveyor 18. The product carrier 102 preferably comprises a plurality of locations on which rims can be positioned. In the present case, two locations 104, 105 are shown by way of example for blanks 74 that can be placed in such locations in upright position. While a blank 74 is positioned in location 104, location 105 is empty and ready to accept a special blank 76, without this disturbing the spindle-synchronous operation of the conveyor 18.

Depending on the desired additional capacity of the device 10 for the treatment of special rims, additional locations may be provided on the different product carriers of the conveyor 18, and/or additional product carriers may be provided on the conveyor for accommodating special blanks in addition to blanks.

Figure 6:
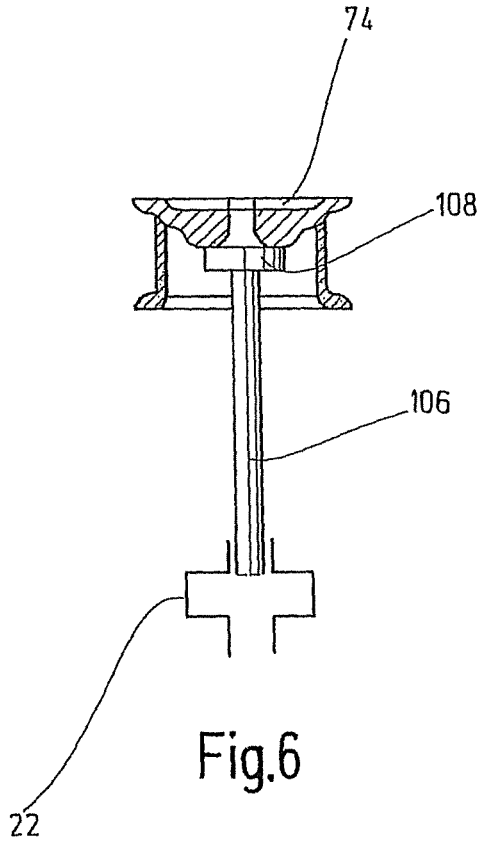
FIG. 6 shows a detail view of a spindle received on a floor conveyor, with a rim placed on the spindle.

FIG. 6 shows by way of example a product carrier 106 in the form of a spindle mounted in a floor conveyor 22. The product carrier 106 projects from the floor conveyor 22 to the top and has a supporting surface 108 on which a blank 74 has been placed in horizontal condition. If in that case special blanks 76 are to be accepted in addition to blanks 74, then a corresponding additional number of product carriers 106 have to be provided on the floor conveyor.

The rims treated according to the invention generally are light-alloy rims, mainly consisting of an aluminum alloy or, in certain cases, of a magnesium alloy or a titanium alloy.

In is understood that the before-mentioned stations or process steps of the different treatment stations, such as the pre-treating station, the powder priming station, the transparent spray station and the final coating station, have been described by way of example only and may be supplemented or used in the way known in principle in the art.

What is claimed:

1. A device for coating wheel rims, configured for the production of standard rims as well as for the production of special rims, comprising:

a pre-treating station;

a powder priming station arranged downstream of said pre-treating station;

a basecoat application station arranged downstream of said powder priming station;

a final coating station arranged downstream of said basecoat application station;

a plurality of conveyors arranged for moving rims through said pre-treating station, said powder priming station, said basecoat application station and said final coating station; and a plurality of handling mechanisms coupled to said conveyors for moving rims therebetween;

wherein each conveyor comprises a plurality of rim locations each configured for receiving one rim; and an electronic control being coupled with each of said pre-treating, powder priming, basecoat application, and final coating stations, and further coupled with each of said conveyors and each of said handling mechanisms, for effecting spindle-synchronous operation of said stations, so that each rim always is assigned to a particular rim location, thereby avoiding double assignments of rims to any particular rim location;

wherein said final coating station is coupled to said pre-treating station and said basecoat application station, and wherein at least one of said conveyors arranged for transferring rims through said final coating station has a capacity of rim locations sufficient to allow a placement of standard rims received from said basecoat application station and a placement of special rims received from said pre-treating station for processing in spindle-synchronous operation.

2. The device of claim 1, further comprising a reworking station coupled to said powder priming station for mechanically reworking a portion of said rims and coupled to said pre-treating station for transferring said rims as special rims through said pre-treating station.

3. The device of claim 2, further comprising a drying station arranged down-stream of said powder priming station, an output end of said drying station being coupled to said reworking station and to said basecoat application station.

4. The device of claim 1, wherein said final coating station is configured as an acrylate powder station.

5. The device of claim 1, wherein a spray booth for transparent lacquer is arranged between said basecoat application station and said final coating station.

6. The device of claim 1, wherein said pre-treating station is configured for pre-treating standard blanks as well as for pre-treating special blanks that were previously powder-coated and mechanically reworked.

7. The device of claim 6, wherein said pre-treating station comprises a conveyor that runs through different pre-treating stations configured for pre-treating standard blanks and special blanks.

8. The device of claim 1, wherein said pre-treating station comprises at least two spray tunnels, each configured for pre-treating blanks and for pre-treating special blanks, and each being assigned a conveyor.

9. The device of claim 1, comprising a plurality of separate pre-treatment stations for pre-treating of standard rims and special rims.

10. The device of claim 1, wherein said final coating station comprises a dryer and a cooling zone that are passed by a common conveyor.

11. The device of claim 1, wherein at least one of said conveyors is configured as a conveyor selected from the group consisting of a circular conveyor, a spindle conveyor, a floor conveyor and a power & free conveyor.

12. The device of claim 1, wherein at least one of said conveyors is configured as a power & free conveyor, said power & free conveyor, a plurality of buffers for receiving pre-treated rims and special rims being coupled with said pre-treating station.

13. A device for coating wheel rims, configured for producing standard rims as well as for producing special rims, comprising a pre-treating station;

a powder priming station arranged downstream of said pre-treating station;

a basecoat application station arranged downstream of said powder priming station;

a final coating station arranged downstream of said basecoat application station;

a plurality of conveyors arranged for moving rims through said pre-treating station, said powder priming station, said basecoat application station and said final coating station; and a plurality of handling mechanisms coupled to said conveyors for moving rims therebetween;

wherein said final coating station is coupled to said pre-treating station and said basecoat application station, and wherein at least one of said conveyors arranged for transferring rims through said final coating station has a capacity of rim locations sufficient to allow a placement of standard rims received from said basecoat application station and a placement of special rims received from said pre-treating station for processing in spindle-synchronous operation.

14. A method for coating wheel rims comprising the steps of:

(a) pre-treating blanks in a pre-treating station;

(b) transferring said blanks, in spindle-synchronous operation, to a conveyor for transferring said blanks through a powder priming station for powder priming, baking and drying said blanks;

(c) transferring a portion of said blanks after powder priming, baking and drying to a station for mechanically reworking said blanks, thereby producing special blanks;

(d) transferring a remaining portion of said blanks after powder priming, baking and drying, in spindle synchronous operation, through a basecoat application station for applying a basecoat;

(e) conveying said blanks, in spindle synchronous operation, to a final coating station and conveying said blanks, in spindle-synchronous operation, through a final coating station for finally coating said blanks with a final coating;

(f) transferring said special blanks through said pre-treating station;

(g) transferring said special blanks, in spindle-synchronous operation, from said pre-treating station to free locations of a conveyor, for transferring said special blanks through said final coating station; and (h) applying a final coating onto said blanks and onto said special blanks within said final coating station.

15. The method of claim 14, wherein said blanks are coated with a transparent coating following said basecoat application step.

16. The method of claim 14, wherein said blanks and said special blanks are moved through said pre-treating station by a common conveyor.

17. The method of claim 14, wherein said blanks and said special blanks are moved through a plurality of pre-treating stations.

18. The method of claim 14, wherein said blanks are moved through at least one spray tunnel, and wherein said special blanks moved through at least one separate spray tunnel.

19. The method of claim 14, wherein said blanks and said special blanks are moved by a conveyor through a common drier zone and cooling zone.

20. The method of claim 14, wherein a portion of said blanks are removed after the basecoat application step, are mechanically reworked, are stored in a buffer and are then, transferred to said pre-treating station as special blanks.

* * * * *